US008584492B2

(12) United States Patent
Seo et al.

(10) Patent No.: US 8,584,492 B2
(45) Date of Patent: Nov. 19, 2013

(54) WASHING MACHINE WITH DETERGENT SUPPLY PATH

(75) Inventors: Dong Pil Seo, Suwon-si (KR); Sang Yeon Pyo, Suwon-si (KR); Hyun Sook Kim, Suwon-si (KR); Jae Ryong Park, Hwaseong-si (KR); Byoung Yull Yang, Hwaseong-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 1051 days.

(21) Appl. No.: 12/585,961

(22) Filed: Sep. 29, 2009

(65) Prior Publication Data

US 2010/0107704 A1 May 6, 2010

(30) Foreign Application Priority Data

Oct. 31, 2008 (KR) ..... 10-2008-107453

(51) Int. Cl.
*D06F 39/02* (2006.01)

(52) U.S. Cl.
USPC ..... 68/17 R; 68/13 R

(58) Field of Classification Search
CPC ..... D06F 39/02
USPC ..... 68/3 R, 13 R, 17 R, 207
See application file for complete search history.

(56) References Cited

U.S. PATENT DOCUMENTS

| | | | | |
|---|---|---|---|---|
| 8,056,374 | B2 * | 11/2011 | Hoppe | 68/12.18 |
| 8,056,747 | B2 * | 11/2011 | Vitan et al. | 220/23.83 |
| 2008/0028802 | A1 * | 2/2008 | Jordan et al. | 68/12.18 |
| 2008/0202173 | A1 * | 8/2008 | Kim et al. | 68/17 R |
| 2008/0229790 | A1 * | 9/2008 | Kim et al. | 68/17 R |
| 2009/0095331 | A1 * | 4/2009 | Hoppe | 134/99.2 |
| 2009/0095750 | A1 * | 4/2009 | Vitan et al. | 220/23.83 |
| 2009/0288452 | A1 * | 11/2009 | Lee et al. | 68/12.18 |
| 2009/0288453 | A1 * | 11/2009 | Lee et al. | 68/17 R |
| 2009/0288454 | A1 * | 11/2009 | Lee et al. | 68/17 R |
| 2010/0139328 | A1 * | 6/2010 | Favaro | 68/12.18 |

FOREIGN PATENT DOCUMENTS

| | | | |
|---|---|---|---|
| CN | 102066642 | | 5/2011 |
| EP | 611843 | A1 * | 8/1994 |
| EP | 1884584 | A2 * | 2/2008 |
| KR | 10-2006-0120936 | | 11/2006 |

* cited by examiner

*Primary Examiner* — Joseph L Perrin
(74) *Attorney, Agent, or Firm* — Staas & Halsey LLP

(57) ABSTRACT

Disclosed herein are a washing machine and a detergent supply path which guides detergent stored in a lower part of a main body of the washing machine to an upper part of the main body. The washing machine includes a main body; a support base removably mounted to the main body; a detergent storage unit mounted at a lower part of the main body to be moved in and out of the main body; a detergent supply path guiding the detergent stored in the detergent storage unit that is in the lower part of the main body, to an upper part of the main body; and a guide unit guiding movement of the detergent supply path according to the movement in and out of the detergent storage unit.

8 Claims, 7 Drawing Sheets

WASHING MACHINE WITH DETERGENT SUPPLY PATH

CROSS-REFERENCE TO RELATED APPLICATIONS

This application claims the benefit of Korean Patent Application No. 2008-0107453, filed on Oct. 31, 2008 in the Korean Intellectual Property Office, the disclosure of which is incorporated herein by reference.

BACKGROUND

1. Field

The present invention relates to a washing machine, and more particularly, to a path connecting a main body with a supporting base in a washing machine.

2. Description of the Related Art

A washing machine refers to an apparatus that washes laundry applying a mechanical force. The washing machine, including an electromotor as a main power source, performs operational courses including washing, rinsing, dehydrating and so on, to remove dirt and contaminants off the laundry using detergent and wash water.

Detergent and a fabric conditioner are supplied to a detergent container, which is divided for every operational course. During the washing course, powdery or liquid detergent is supplied. During the rinsing course, a liquid conditioner is supplied. The detergent and wash water are supplied together into a rotational tub during the washing course, thereby removing contaminants attached to the laundry. Meanwhile, during the rinsing course, the liquid conditioner is supplied into the rotational tub together with wash water, thereby softening the laundry fabric.

The detergent and the fabric conditioner are supplied directly by a user. The user determines quantities of the detergent and the fabric conditioner to be supplied, according to an amount of the laundry to be washed. Thus, when using a conventional washing machine, the user has to determine the quantity of the detergent and the conditioner depending on the laundry amount and supply the detergent and the conditioner, all directly. This is cumbersome for the user.

To this end, in addition to the detergent container to store a predetermined quantity of the detergent and the conditioner, the washing machine further includes an automatic detergent supply device capable of supplying the detergent and the conditioner according to the laundry amount. As the detergent container is enlarged to store more detergent and conditioner than in the past, it is required to secure a larger space to store the enlarged detergent container.

Furthermore, a detergent supply path needs to be provided in the washing machine to guide the detergent stored in the detergent container into the rotational tub. Since the detergent container is formed in a separate space, the detergent supply path has a relatively long length and therefore may be twisted or entangled. If so, the detergent would not be favorably supplied.

For a user's convenience, a support base may be formed under the washing machine. In other words, the user may connect or separate the support base with respect to a main body of the washing machine as necessary. However, for connection and separation of the support base, the detergent supply path also needs to be connected or separated.

SUMMARY

Therefore, it is an aspect of the present embodiments to provide a path structure which guides a supply of detergent in accordance with connection and separation of a detergent storage unit with respect to a support base of a washing machine.

It is another aspect of the present embodiments to provide a path structure to guide detergent from a support base to a main body of a washing machine, where the main body and the support base are separably connected with each other.

Additional aspects and/or advantages of the invention will be set forth in part in the description which follows and, in part, will be obvious from the description, or may be learned by practice of the invention.

The foregoing and/or other aspects are achieved by providing a washing machine including a main body; a support base removably mounted to the main body; a detergent storage unit mounted at a lower part of the main body to be moved in and out of the main body; a detergent supply path guiding the detergent stored in the detergent storage unit disposed at the lower part of the main body, to an upper part of the main body; and a guide unit guiding movement of the detergent supply path according to in and out operations of the detergent storage unit.

The guide unit may guide the movement of the detergent supply path as the detergent storage unit is moved in and out of the main body.

The guide unit may guide the movement of the detergent supply path in a direction across the in and out movement of the detergent storage unit.

The guide unit may include a link unit which is bendable and stretchable.

The guide unit may include a path fixing part that fixes the detergent supply path.

The path fixing part may be provided in a plural number.

The support base may include a case and a receiving member configured to be moved in and out of the case, and the detergent storage unit may be formed in the receiving member.

The guide unit may guide the detergent supply path in association with the movement of the receiving member.

The guide unit may include a first link member and a second link member connected thereto that is bendable and stretchable, the first link member may include a first connection part supported by the receiving member, and the second link member may include a second connection part supported by the case.

The main body and the support base may be separably connected to each other, and the detergent supply path may include a first supply path formed at the support base and a second supply path formed at the main body and separably connected with the first supply path.

The washing machine may further include a connection unit fluidly communicating the first supply path and the second supply path with each other.

The connection unit may include a first connection part connected to the first supply path; a second connection part connected to the second supply path; and a communication part disposed between and connecting the first and second connection parts.

The connection unit may include a first connection part formed at the first supply path; and a second connection part formed at the second supply path, the first and second supply paths being fluidly communicated through connection between the first and second connection parts.

The foregoing and/or other aspects are achieved by providing a washing machine including a main body; a support base removably mounted to the main body; a detergent storage unit mounted to the support base; and a detergent supply path guiding the detergent stored in the detergent storage unit to the main body, the detergent supply path including a first supply path formed at the support base and a second supply path formed at the main body and separably connected with the first supply path.

The washing machine may further include a connection unit fluidly communicating the first supply path and the second supply path with each other.

The connection unit may include a first connection part connected to the first supply path; a second connection part connected to the second supply path; and a communication part disposed between and connecting the first and second connection parts.

The connection unit may include a first connection part formed at the first supply path; and a second connection part formed at the second supply path, wherein the first and second supply paths are fluidly communicated through connection between the first and second connection parts.

As can be appreciated from the above, since there is provided a dedicated connection unit enabling connection and separation of a detergent supply path, connection and separation between a main body and a support base can be facilitated.

In addition, by providing a link unit that guides variation of a shape of the detergent supply path, entanglement of the detergent supply path is prevented, thereby enhancing flow of the detergent in a liquid form.

Furthermore, since a detergent storage unit is disposed at the support base, spatial efficiency can be improved.

BRIEF DESCRIPTION OF THE DRAWINGS

These and/or other aspects and advantages will become apparent and more readily appreciated from the following description of the embodiments, taken in conjunction with the accompanying drawings of which.

DETAILED DESCRIPTION OF EMBODIMENTS

Figure 1:
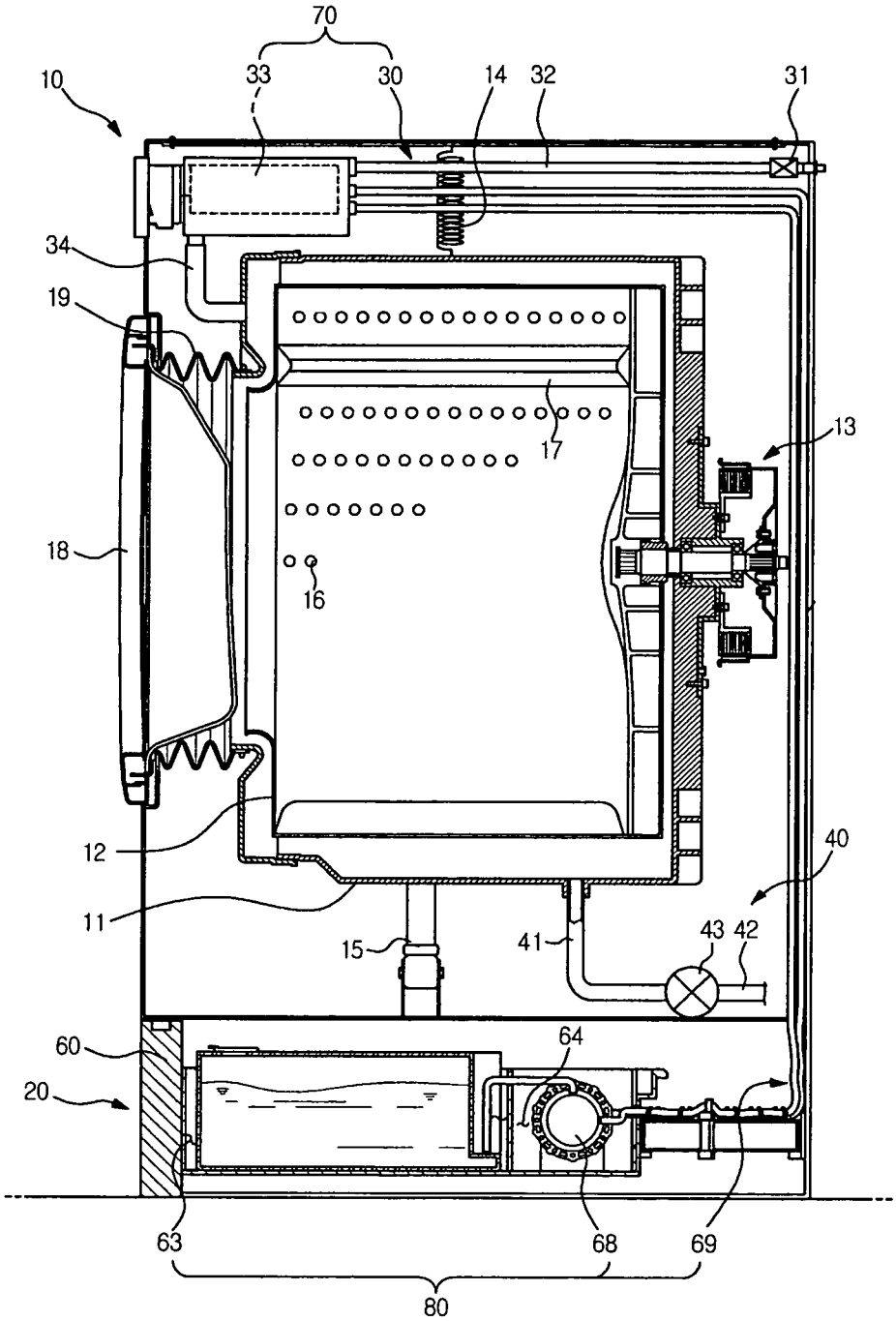
FIG. 1 shows main parts of a washing machine according to a first embodiment.

Reference will now be made in detail to the embodiments, examples of which are illustrated in the accompanying drawings, wherein like reference numerals refer to the like elements throughout. The embodiments are described below to explain the present invention by referring to the figures.

FIG. 1 is a view showing main parts of a washing machine according to a first embodiment.

Referring to FIG. 1, the washing machine includes a main body 10 constituting an exterior appearance thereof. A variety of devices to perform washing are mounted inside the main body 10.

More specifically, the main body 10 includes a water tub 11, a rotational tub 12, and a driving unit 13. The water tub 11 is equipped with a spring 14 and a damper 15 to absorb shocks. The rotational tub 12 is rotatably mounted in the water tub 11. The driving unit 13 is disposed at a rear side of the water tub 11 to supply a rotative force to the rotational tub 12.

The water tub 11 stores wash water, and the wash water is flowed into the rotational tub 12 via holes 16 in the rotational tub 12. In the rotational tub 12, a plurality of lifters 17 are mounted to lift and drop laundry by a predetermined height.

The main body 10 includes a door 18 opening and closing the rotational tub 12 to put in and take out the laundry. The user is able to put the laundry in and take the laundry out of the rotational tub 12 by opening the door 18. In addition, a gasket 19 is interposed between the door 18 and the rotational tub 12 to prevent leakage of the wash water.

The main body 10 further includes a water supply unit 30 to supply the wash water. The water supply unit 30 includes a supply valve 31, a supply hose 32 connected with a first detergent storage unit 33, and a supply bellows 34 connecting the first detergent storage unit 33 with the water tub 11. The wash water is flowed into the first detergent storage unit 33 passing through the supply hose 32. In the first detergent storage unit 33, the wash water is mixed with detergent or a fabric conditioner stored in the first detergent storage unit 33 and then guided to the water tub 11 through the supply bellows 34.

The main body 10 further includes a water discharge unit 40 to discharge the wash water. The water discharge unit 40 includes a discharge bellows 41 connected with the water tub 11, a discharge hose 42 discharging the wash water out of the washing machine, and a discharge pump 43 disposed between the discharge bellows 41 and the discharge hose 42. Upon operation of the discharge pump 43, the wash water is passed through the discharge bellows 41 and the discharge hose 42 and discharged to the outside.

The main body 10 further includes a receiving member 60 disposed at a lower part thereof to be moved in and out. Since the receiving member 60 is connected to the main body 10 through a rail, the user is capable of moving the receiving member 60 in and out with respect to the main body 10. Specifically, a first guide rail 61 (see FIG. 2) formed to the receiving member 60 slides along a second guide rail 56 formed to the main body 10. The first guide rail 61 is mounted with rollers so as to smoothly slide on the second guide rail 56.

Figure 2:
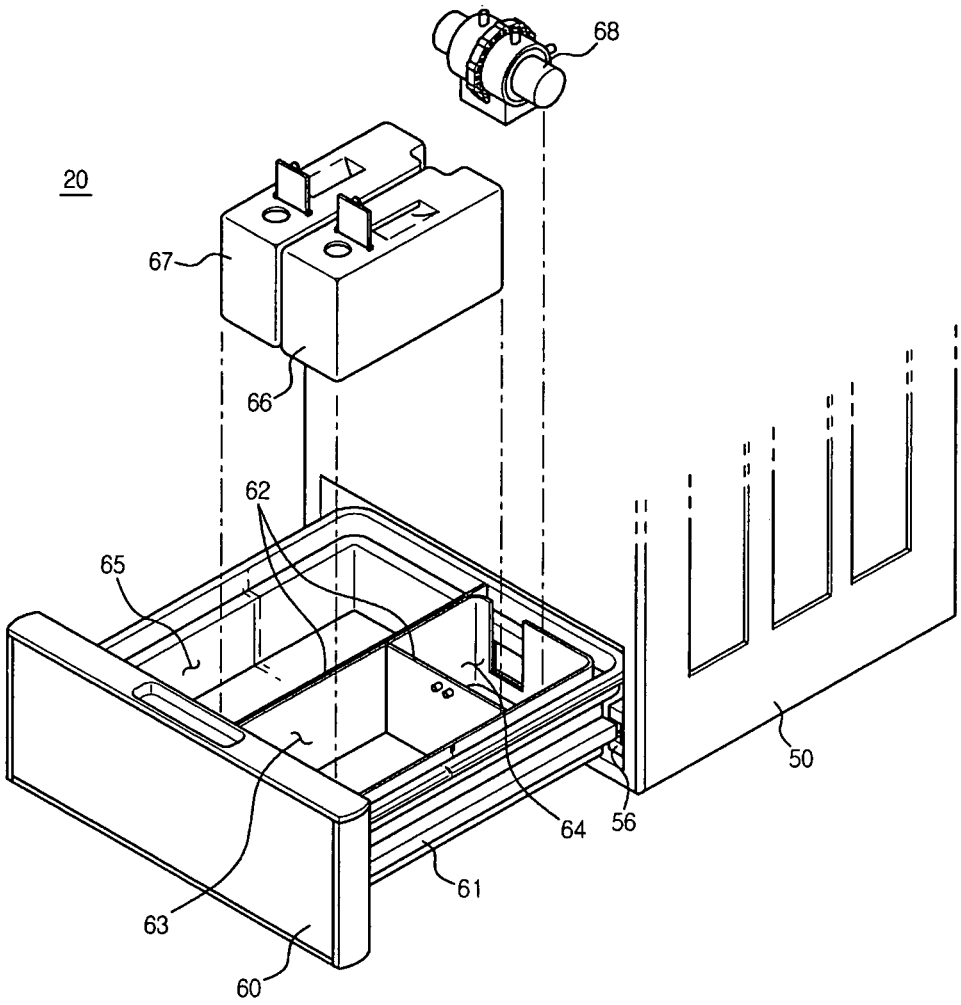
FIG. 2 shows a receiving member of the washing machine according to the first embodiment.

FIG. 2 shows the receiving member 60 according to the embodiment.

Referring to FIG. 1 and FIG. 2, the receiving member 60 has an opened top side and holds a receiving space therein to store various stuff such as the detergent and the fabric conditioner. More particularly, the receiving member 60 is sectioned by partitions 62 into a second detergent storage unit 63 storing the detergent and the conditioner, a pump mounting unit 64 in which a pump is mounted, and an item storage unit 65 storing other items.

The second detergent storage unit 63 may include a detergent box 66 storing a liquid detergent and a conditioner box 67 storing a liquid conditioner. Also, the second detergent storage unit 63 may be simply partitioned to separately store the liquid detergent and the liquid conditioner rather than including dedicated storage boxes.

In the pump mounting unit 64, a detergent supply pump 68 is mounted, which pumps up the liquid detergent stored in the second detergent storage unit 63 toward the main body 10. More specifically, the detergent supply pump 68 pumps up the liquid detergent in the second detergent storage unit 63 toward the first detergent storage unit 33 mounted in the main body 10. The liquid detergent flowing from the second detergent storage unit 63 to the first detergent storage unit 33 is supplied to the water tub 11 along with the wash water.

The item storage unit 65 may receive other items. Thus, the receiving member 60 according to the embodiment can be used to store not only detergent, but also other items, in the same manner as in the conventional art.

Hereinafter, a structure to supply detergent in the washing machine according to the embodiment will be explained.

The washing machine includes a detergent supply device including a first detergent supply unit 70 formed at the main body 10 and a second detergent supply unit 80 formed at a support base 20 of the main body 10.

The first detergent supply unit 70 includes the first detergent storage unit 33 and the water supply unit 30. The first detergent storage unit 33 can be moved in and out with respect to the main body 10. Therefore, the user takes out the first detergent storage unit 33 from the main body 10 to supply detergent and conditioner and then puts the first detergent storage unit 33 back into the main body 10. Wash water is supplied to the first detergent storage unit 33 by the water supply unit 30 and mixed with the detergent or the conditioner stored in the first detergent storage unit 33. The mixture of the detergent or the conditioner with the wash water is supplied to the water tub 11 through the supply bellows 34.

The user supplies the detergent or the conditioner into the first detergent storage unit 33 according to the amount of laundry every time of the laundry washing. Although it is usual that powdery detergent is supplied in the first detergent storage unit 33, liquid detergent may also be supplied. When the powdery detergent is supplied to the first detergent storage unit 33, the first detergent supply unit 70 supplies the detergent to the water tub 11 using the water supply unit 30. When the liquid detergent is supplied, on the other hand, the liquid detergent can be supplied to the water tub 11 without requiring the operation of the water supply unit 30.

The second detergent supply unit 80 includes the second detergent storage unit 63, the detergent supply pump 68, and a detergent supply path 69. The user takes out the receiving member 60 from the lower part of the main body 10 to supply the liquid detergent and the liquid conditioner to the second detergent storage unit 63, and then puts the receiving member 60 back into the lower part of the main body 10. The liquid detergent or conditioner is moved from the second detergent storage unit 63 to the first detergent storage unit 33 by operation of the detergent supply pump 68 through the detergent supply path 69. The liquid detergent or conditioner flowed from the second detergent storage unit 63 to the first detergent storage unit 33 is then supplied to the water tub 11 through the supply bellows 34.

The detergent supply path 69, which connects the first detergent storage unit 33 to the second detergent storage unit 63, is varied in shape as the second detergent storage unit 63 is moved in and out. Therefore, a guide unit 110 guiding the shape variation of the detergent supply path 69 is provided in this embodiment, which will be described in detail later.

Figure 3:
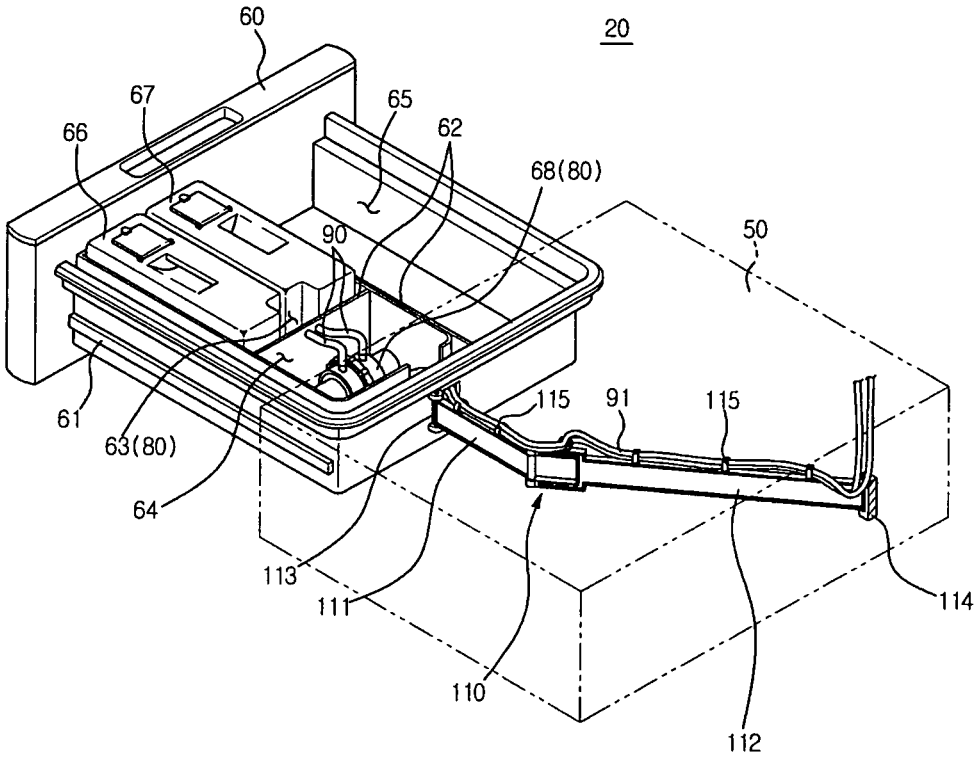
FIG. 3 and FIG. 4 show operations of a link unit of the washing machine.
Figure 4:
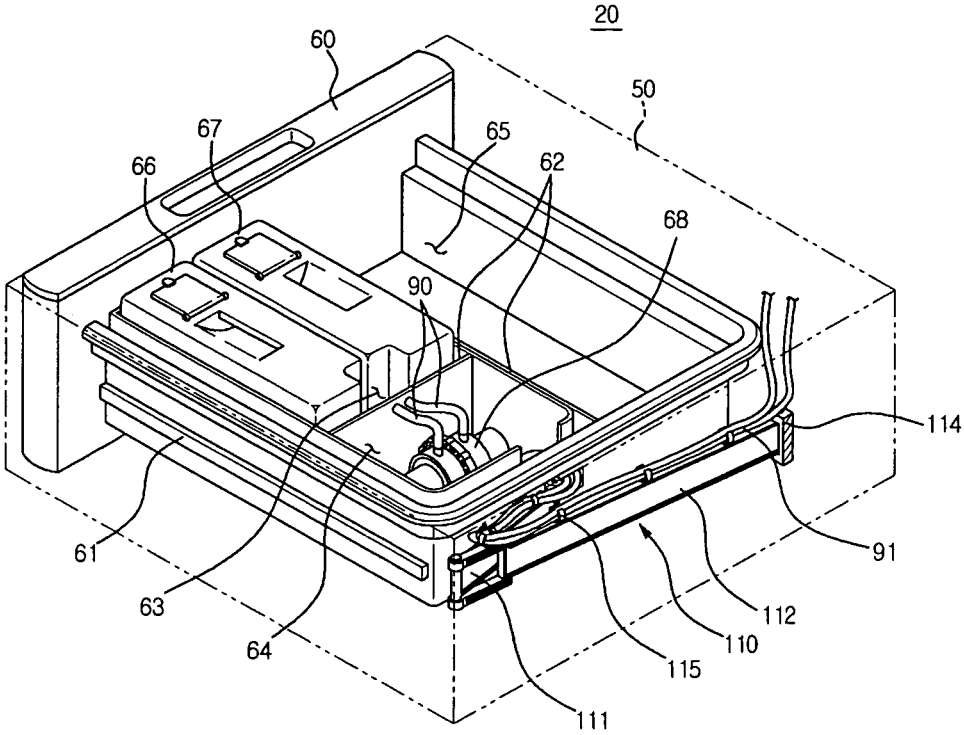

FIG. 3 and FIG. 4 are views showing the operation of a link unit of the washing machine according to the embodiment.

As shown in FIG. 3 and FIG. 4, the receiving member 60 is mounted to be moved in and out of the lower part of the main body 10. The detergent supply path 69 is formed between the receiving member 60 and the main body 10 to be moved along with the receiving member 60 as the receiving member 60 is taken out (FIG. 3). On the other hand, when the receiving member 60 is moved in, the detergent supply path 69 is moved in the same direction as the receiving member 60 (FIG. 4). That is, an extended length and a shape of the detergent supply path 69 are often varied according to the operation of the receiving member 60. Therefore, twist or entanglement of the detergent supply path 69 may be caused, accordingly hindering smooth supply of the liquid detergent or conditioner. To this end, the guide unit 110 capable of preventing the entanglement of the detergent supply path 69 is provided in this embodiment. The link unit is an example of the guide unit 110.

The guide unit 110 is disposed between the receiving member 60 and the main body 10. The guide unit 110 includes a plurality of link members which are interconnected and capable of bending and stretching. Referring to FIG. 3 and FIG. 4, the guide unit 110 includes two link members 111 and 112, that is, a first link member 111 and a second link member 112 interconnected through a hinge to be bendable and stretchable.

A first connection part 113 of the first link member 111 is fixed to the receiving member 60 while a second connection part 114 of the second link member 112 is fixed to the main body 10. Therefore, the guide unit 110 operates in association with the receiving member 60. More specifically, when the receiving member 60 is taken in and out, the guide unit 110 is varied in length in the direction that the receiving member 60 is taken in and out. As shown in FIG. 3, when the receiving member 60 is taken out, the guide unit 110 is stretched out along with the operation of the receiving member 60, thereby being elongated. As shown in FIG. 4, when the receiving member 60 is moved in, the guide unit 110 is bent along with the operation of the receiving member 60, thereby being shortened.

As described above, entanglement of the detergent supply path 69 can be prevented using the guide unit 110. The guide unit 110 includes a plurality of path fixing parts 115 which securely engage the detergent supply path 69 with the guide unit 110. Therefore, as the guide unit 110 is varied in length, the detergent supply path 69 is accordingly varied in shape as shown in FIG. 3 and FIG. 4. Thus, the guide unit 110 prevents entanglement of the detergent supply path 69 by guiding the shape variation of the detergent supply path 69 as shown in FIG. 3 and FIG. 4.

Figure 5:
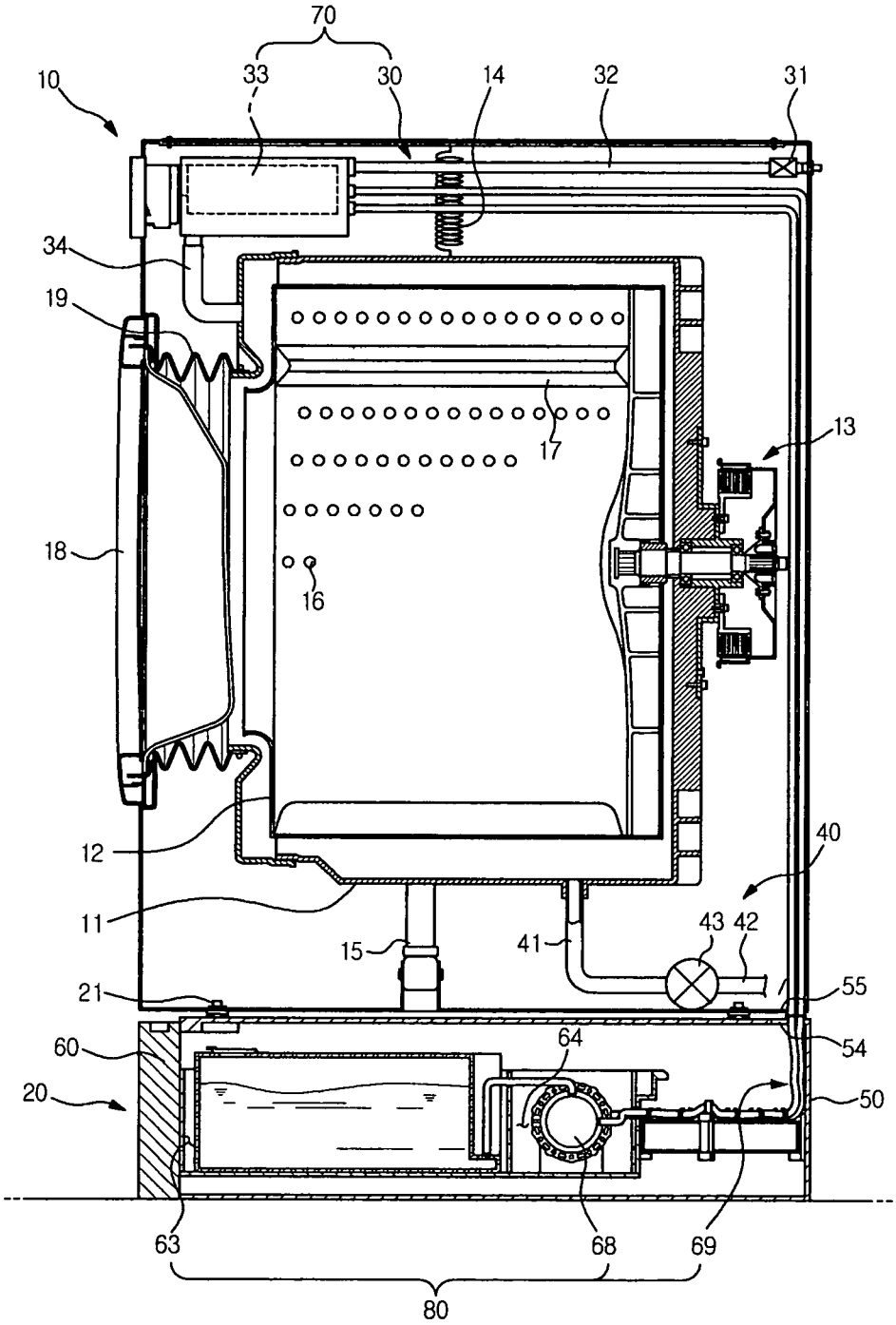
FIG. 5 shows main parts of a washing machine according to a second embodiment.

FIG. 5 shows main parts of a washing machine according to a second embodiment.

Referring to FIG. 5, the washing machine includes a main body 10, and a support base 20 that supports the main body 10. Hereinafter, only distinctive features of the second embodiment from the first embodiment will be described, using the same drawings and reference symbols when describing the features already explained with the first embodiment.

The support base 20 is removably mounted to the main body 10. The support base 20 includes a case 50 and the receiving member 60 configured to be moved in and out of the case 50. The user can connect and separate the case 50 using a fixing member 21, such as bolts and nuts, for example.

The guide unit 110 may be provided to guide the shape variation of the detergent supply path 69 according to the in and out operation of the receiving member 60. Since the guide unit 110 can be structured as illustrated in FIG. 1 to FIG. 4, a detailed description thereof will be omitted.

The detergent supply path 69 is mounted passing through a first communication groove 54 formed at the case 50 and a second communication groove 55 formed at the main body 10.

The detergent supply path 69 is mounted to connect the second detergent storage unit 63 and the first detergent storage unit 33 to each other when the support base 20 is mounted to the main body 10, and disconnect the second detergent storage unit 63 and the first detergent storage unit 33 from each other when the support base 20 is separated from the main body 10.

Figure 6:
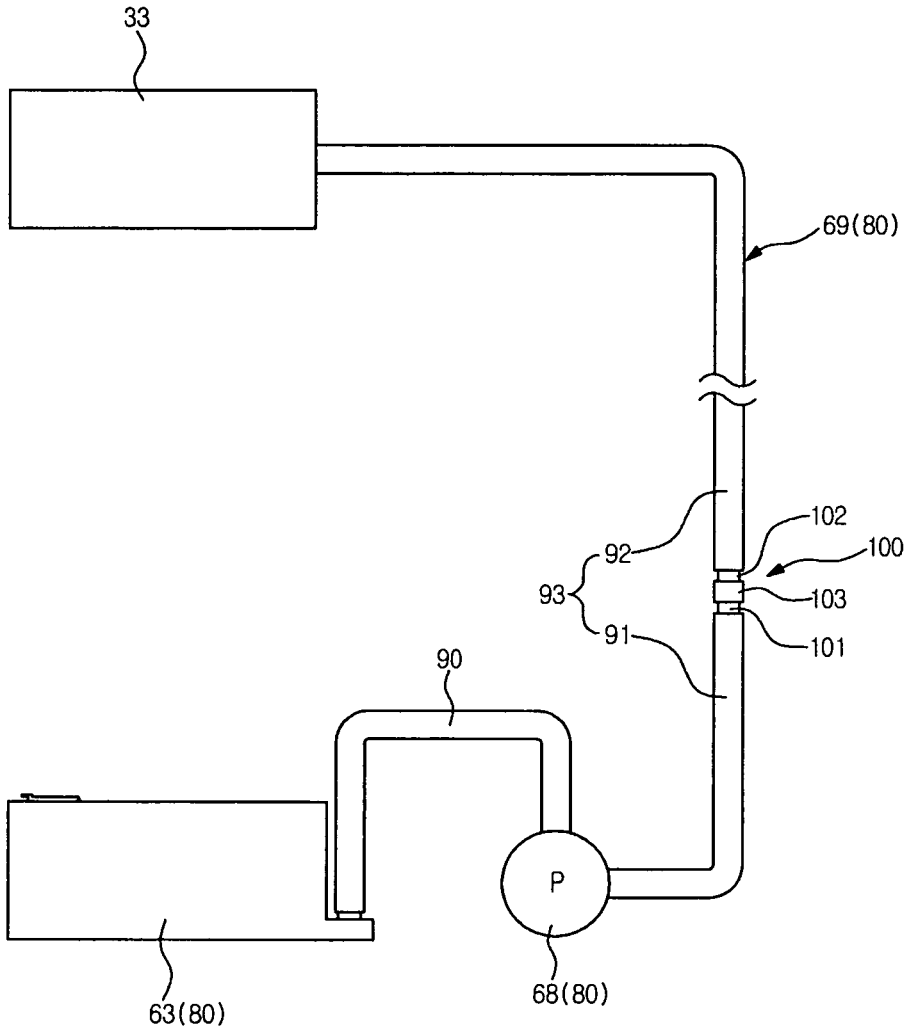
FIG. 6 shows a detergent supply path according to the second embodiment.

FIG. 6 shows a detergent supply path according to the second embodiment.

Referring to FIG. 5 and FIG. 6, the detergent supply path 69 according to the second embodiment includes a connection path 90 disposed between the second detergent storage unit 63 and the first detergent storage unit 33, and a supply path 93 disposed between the detergent supply pump 68 and the first detergent storage unit 33. Here, the detergent supply path 69 is divided into a liquid detergent guiding path and a liquid conditioner guiding path. The path explained hereinafter will be all considered to have the two paths, that is, the liquid detergent guiding path and the liquid conditioner guiding path. However, the present invention can be embodied although the detergent supply path 69 includes only one path to guide either one of the liquid detergent and the liquid conditioner.

The support base 20 can be mounted to and separated from the main body 10 as necessitated by the user. Corresponding to this, the paths of the supply path 93 can be separated respectively toward the supporting base 20 and the main body 10, or connected to each other. Specifically, the supply path 93 may include a first supply path 91 formed at the support base 20 and a second supply path 92 formed at the main body 10, and the first and second supply paths 91 and 92 may be connected to and separated from each other through a connection unit 100.

The connection unit 100 includes a first connection part 101 connected with the first supply path 91, a second connection part 102 connected with the second supply path 92, and a fluid communication part 103 interposed between the first and second connection parts 101 and 102. Since the first and second connection parts 101 and 102 are thus fluidly communicated with each other, the liquid detergent is capable of moving through the first supply path 91, the connection unit 100, and the second supply path 92 in sequence.

On the contrary, in a case where the main body 10 and the support base 20 are integrally formed as shown in FIG. 1, the supply path 93 does not have to separately include the first supply path 91 and the second supply path 92. Accordingly, the connection unit 100 is dispensable. However, according to the present embodiment, although the main body 10 and the support base 20 are integrally formed with each other, the supply path 93 may be separated into the first and second supply paths 91 and 92 and the connection unit 100 may be provided between the first and second supply paths 91 and 92.

To summarize, as shown in FIG. 5 and FIG. 6, the first and second supply paths 91 and 92 can be connected to and separated from each other using the connection unit 100 when the main body 10 and the support base 20 are connected to and separated from each other, respectively. Thus, the user is able to connect and separate the support base 20 with respect to the main body 10 as desired.

Figure 7:
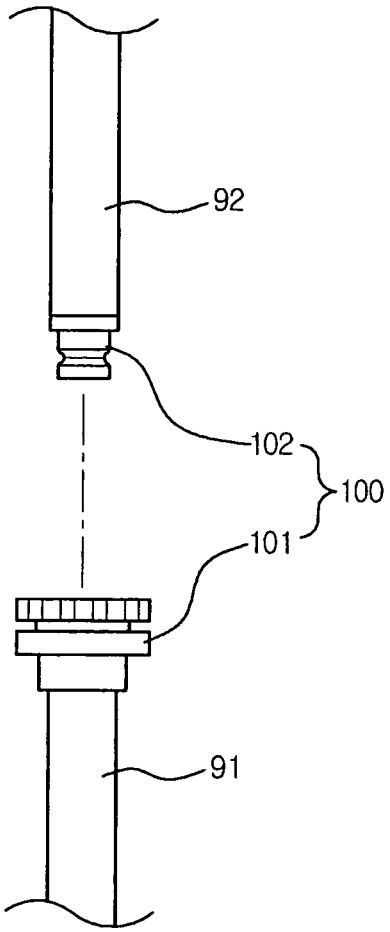
FIG. 7 shows a connection unit according to the second embodiment.

FIG. 7 shows the connection unit according to the second embodiment.

As shown in FIG. 7, the connection unit 100 includes the first connection part 101 formed at an end of the first supply path 91, and a second connection part 102 formed at an end of the second supply path 92. The first and second connection parts 101 and 102 are fitted with each other to be fluidly communicated. Therefore, the liquid detergent can be moved through the first supply path 91, the connection unit 100, and the second supply path 92 in sequence.

Hereinafter, the operation of the washing machine according to the embodiments will be explained in detail with reference to FIGS. 1 to 7.

When the main body 10 and the support base 20 are separably formed as shown in FIG. 5, the user or operator connects or separates the support base 20 with respect to the main body 10 as necessary. Here, the user or operator connects or separates the first supply path 91 and the second supply path 92 using the connection unit 100 as shown in FIG. 6 and FIG. 7.

When the main body 10 and the support base 20 are integrally formed as shown in FIG. 1, the supply path 93 connects the main body 10 with the support base 20 as a single path. That is, the supply path 93 does not have to be divided into the first and second supply paths 91 and 92 and also the connection unit 100 is not required for the connection of the supply paths 91 and 92.

After the washing machine is thus installed, the detergent is put in before operation of the washing machine.

First, when the user has to supply the detergent directly, the first detergent supply unit 70 operates as follows. The user opens the first detergent storage unit 33 and puts the powdery detergent and the liquid conditioner into the first detergent storage unit 33. Upon operation of the washing machine, the wash water is flowed into the first detergent storage unit 33 by the water supply unit 30. The wash water flowed to the first detergent storage unit 33 is supplied to the water tub 11 together with the detergent or the conditioner. When performing the washing again the next time, the user has to open the first detergent storage unit 33 and supply the powdery detergent and the liquid conditioner again.

When supply of the detergent is automatically performed, the second detergent supply unit 80 operates as follows. The user opens the receiving member 60 and supplies the liquid detergent and the liquid conditioner respectively into the detergent box 66 and the conditioner box 67 formed in the second detergent storage unit 63. Then, when the washing machine is operated, the liquid detergent or the liquid conditioner is guided from the second detergent storage unit 63 to the first detergent storage unit 33 by the detergent supply pump 68 and the detergent supply path 69, and then supplied to the water tub 11 through the supply bellows 34. Since the second detergent storage unit 80 has a relatively large capacity, the user does not have to supply the detergent or the conditioner by opening the second detergent storage unit 63 every subsequent time.

However, when the liquid detergent or conditioner stored in the second detergent storage unit 63 is exhausted after several times of the operation, the user can supply the liquid detergent or conditioner in the second detergent storage unit 63 by taking out the receiving member 60.

Even while the receiving member 60 is being put in and taken out, the detergent supply path 69 is varied in its length and shape under the guidance of the guide unit 110. Therefore, entanglement of the detergent supply path 69 can be prevented, thereby securing smooth flow of the liquid detergent or conditioner through the detergent supply path 69.

In addition, the receiving member 60 is moved in and out when the user puts some items in the item storage unit 65. In this case as well, the detergent supply path 69 is moved under the guidance of the guide unit 110, thereby being prevented from entanglement.

Although a few embodiments have been shown and described, it would be appreciated by those skilled in the art that changes may be made in these embodiments without departing from the principles and spirit of the invention, the scope of which is defined in the claims and their equivalents.

What is claimed is:

1. A washing machine, comprising:

a main body;

a support base removably mounted to the main body and including a case and a receiving member configured to be moved in and out of the case;

a detergent supply path to guide the detergent stored in the receiving member to the main body; and a guide unit to guide movement of the detergent supply path according to in and out operations of the receiving member, wherein the guide unit includes a first link member and a second link member connected thereto that is bendable and stretchable, wherein the first link member comprises a first connection part connected to a rear surface of the receiving member at a position biased to one side from a center of a width direction of the receiving member, and the second link member comprises a second connection part connected to an inner surface of the case at a position biased to one side from a center of a width direction of the case.

2. The washing machine according to claim 1, wherein the guide unit is provided to be bendable and stretchable in the width direction of the receiving member.

3. The washing machine according to claim 2, wherein the guide unit is provided to allow the first link member and the second link member to form an obtuse angle with each other, in a state in which the receiving member is taken out of the case.

4. The washing machine according to claim 3, wherein the guide unit is provided to have a length smaller than a width of the inner surface of the case so as to be received within the case in a state in which the receiving member is completely inserted in the case.

5. A washing machine, comprising:

a main body;

a case mounted below the main body;

a receiving member configured to be moved in and out of the case;

a detergent supply path to guide the detergent stored in the receiving member to the main body; and a guide unit to guide movement of the detergent supply path according to in and out operations of the receiving member, wherein the guide unit includes a first link member and a second link member connected thereto that is bendable and stretchable, and wherein the first link member comprises a first connection part connected to a rear surface of the receiving member at a position biased to one side from a center of a width direction of the receiving member, and the second link member comprises a second connection part connected to an inner surface of the case at a position biased to one side from a center of a width direction of the case, and wherein the guide unit is provided to allow the first link member and the second link member to form an obtuse angle with each other, in a state in which the receiving member is taken out of the case.

6. The washing machine of claim 5, wherein the guide unit is provided to be bendable and stretchable in the width direction of the receiving member.

7. The washing machine of claim 6, wherein the guide unit is provided to have a length smaller than a width of the inner surface of the case so as to be received within the case in a state in which the receiving member is completely inserted in the case.

8. The washing machine of claim 7, wherein:

the first link member is provided to have a length corresponding to a distance between the position, to which the first connection part is connected, and one of both side surfaces of the receiving member that is close to the position; and the second link member has a length corresponding to a width of the receiving member.

* * * * *